United States Patent [19]

Crow, Jr.

[11] 4,362,042

[45] Dec. 7, 1982

[54] METHOD OF FORMING A FASTENER

[75] Inventor: Glendon L. Crow, Jr., Gardendale, Ala.

[73] Assignee: The Lamson & Sessions Co., Cleveland, Ohio

[21] Appl. No.: 192,650

[22] Filed: Oct. 1, 1980

[51] Int. Cl.[3] ..... B21D 31/00; B21D 53/00; B21K 1/44

[52] U.S. Cl. ..... 72/353; 10/27 H; 72/357; 72/361; 72/364

[58] Field of Search ..... 10/10 R, 11 R, 24, 26, 10/27 R, 27 H; 72/364, 353, 357, 360, 361

[56] References Cited

U.S. PATENT DOCUMENTS

| | | | |
|---|---|---|---|
| 2,814,059 | 11/1957 | Lehning | 10/27 R |
| 2,939,160 | 6/1960 | Mitchell | 10/26 |
| 2,953,794 | 9/1960 | Klooz | 10/27 H |
| 3,284,825 | 11/1966 | Brauchla | 10/10 R |
| 3,783,462 | 1/1974 | Steffan | 10/27 H |

*Primary Examiner*—Ervin M. Combs

*Attorney, Agent, or Firm*—Yount & Tarolli

[57] ABSTRACT

An improved method of forming a fastener having a head and a shank includes the step of heating one end of a piece of barstock. A ring is then telescopically slid onto the cold end and moved toward the hot end of the barstock. Due to thermal expansion of the hot end of the barstock, the ring interferes with the hot end of the barstock. The ring is then engaged by a pair of dies and the barstock is forced further through the ring to accurately position it relative to the ring. The dies are then pressed against the barstock and the ring to grip the barstock and hold it against axial movement relative to the ring. The dies cooperate with the ring to form a die cavity. The hot end of the barstock extends into the die cavity. A header hot works the metal of the barstock to press it against an end surface of the ring and against side surfaces of the dies to shape the head end of the fastener. The header is then withdrawn, the dies are separated and the ring is removed from the shank of the fastener.

17 Claims, 7 Drawing Figures

METHOD OF FORMING A FASTENER

BACKGROUND OF THE INVENTION

This invention relates generally to a method of forming a fastener, and more specifically to a method of forming a fastener having a head end and a shank.

The head ends of bolts have previously been formed by both cold working and hot working operations. Split dies have previously been used to grip a piece of barstock during heading operations in a manner generally similar to the disclosures in U.S. Pat. Nos. 560,962 and 721,659. In addition, annular die inserts or press members have been used in the forming of head ends of fasteners in a manner generally similar to that disclosed in U.S. Pat. Nos. 2,814,059 and 2,939,160. When using split dies, the making of a precision fastener requires a machining operation to remove the flash which occurs at the joint between the dies.

SUMMARY OF THE PRESENT INVENTION

The present invention provides a new and improved method of forming a fastener having a head end portion and a shank. When the fastener is to be formed, one end portion of a workpiece is heated. A ring is then moved telescopically along the workpiece toward the hot end portion of the workpiece. This axial movement of the ring along the workpiece is interrupted by interference between the ring and the hot end portion of the workpiece which expands as it is heated.

The ring is then engaged by a pair of die blocks and the workpiece forced through the ring until the ring is in a desired position along the workpiece. The dies then grip the relatively cold end portion of the workpiece and hold the ring and workpiece against axial movement relative to each other. In addition to holding the ring and workpiece against movement relative to each other, the dies cooperate with the ring to form a die cavity which surrounds the hot end portion of the workpiece.

A header or ram is then used to form the head end of the fastener by hot working the workpiece in the die cavity. As the material of the workpiece is hot worked, it is pressed against both an end surface of the ring and side surfaces of the dies to shape the head end of the fastener. Once the head end of the fastener has been formed by the hot working operation, the ring is disengaged from the fastener and subsequently used in the formation of another fastener.

Accordingly, it is an object of this invention to provide a new and improved method of forming a fastener having a head end and shank and wherein a ring and a plurality of die sections cooperate to form a die cavity in which the head end of the fastener is formed.

Another object of this invention to provide a new and improved method of forming a fastener and wherein one end portion of a longitudinally extending workpiece is heated and a ring is moved along the workpiece until it interferes with the heated end portion of the workpiece, the workpiece and ring are then held against movement relative to each other while the heated end portion of the workpiece is shaped to form a head end of the fastener.

BRIEF DESCRIPTION OF THE DRAWINGS

The foregoing and other objects and features of the present invention will become more apparent upon a consideration of the following description taken in conjunction with the accompanying drawings wherein.

DESCRIPTION OF ONE SPECIFIC PREFERRED EMBODIMENT OF THE INVENTION

Figure 1:
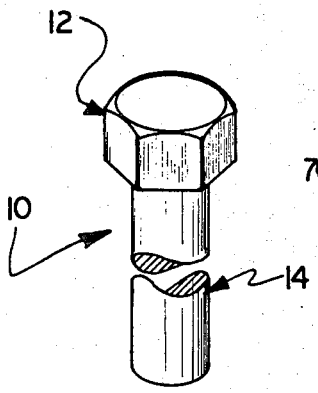
FIG. 1 is an illustration of a fastener having a head end and a shank.

A metal fastener 10 having a head end 12 and a shank 14 is illustrated in FIG. 1. Although the fastener 10 has been shown without threads on the shank 14, it should be understood that the fastener is intended to be a bolt and will have threads formed on the cylindrical shank 14 in a known manner. However, the method of the present invention could be used to form fasteners which have unthreaded shanks.

The fastener 10 is formed from a longitudinally extending piece of cylindrical barstock 18 (FIG. 2) having a substantially uniform diameter throughout its entire length. The piece of barstock 18 has a length which is greater than the length of the shank 14 and contains a volume of metal equal to the total volume of metal contained in the fastener 10. Thus, the length of the barstock or workpiece 18 is such that the head 12 of the fastener 10 can be formed on the shank 14 by upsetting the barstock.

Figure 2:
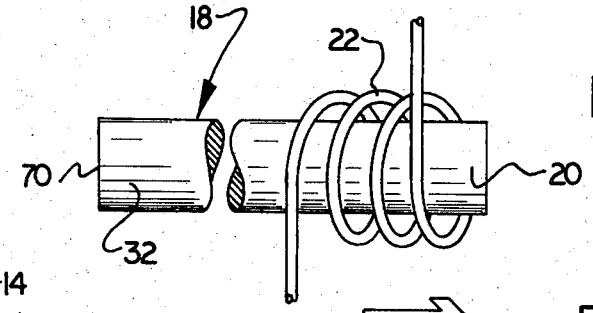
FIG. 2 is a schematic illustration depicting heating of one end portion of a longitudinally extending workpiece.
Figure 4:
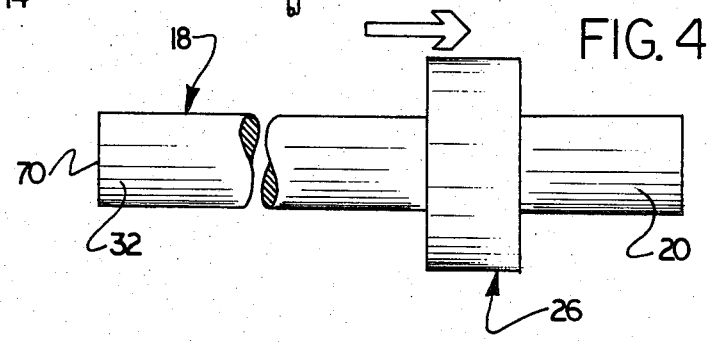
FIG. 4 is a schematic illustration depicting the manner in which the ring of FIG. 2 is telescopically moved along the workpiece until it interferes with the thermally expanded heated end portion of the workpiece.
Figure 3:
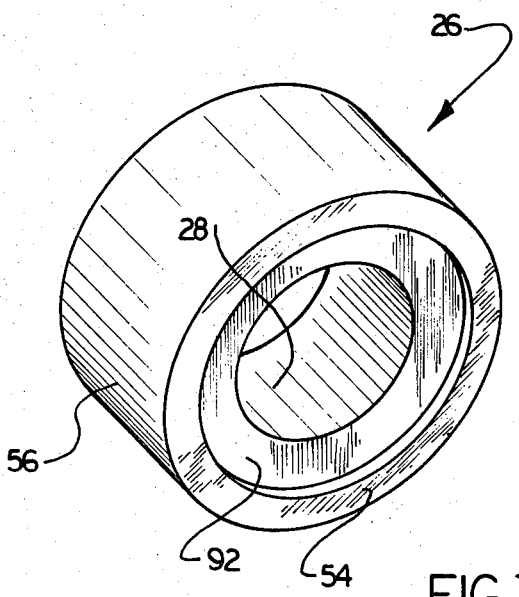
FIG. 3 is an illustration of a ring.

In order to form the fastener 10, one end portion 20 of the barstock or workpiece 18 is heated by an induction heater 22 in the manner illustrated schematically in FIG. 2. An annular ring 26 having a cylindrical central passage 28 (FIG. 3) is axially aligned with a relatively cold or unheated end portion 32 of the barstock 18. The barstock 18 is then telescopically inserted into the opening 28 in the ring 26. The ring 26 is telescopically moved along the barstock from a relatively cool left end portion 32 (as viewed in FIG. 4) toward the relatively hot right end portion 20.

Due to thermal expansion of the barstock as it is heated in the manner illustrated schematically in FIG. 2, the relatively hot end portion 20 will have a larger transverse cross sectional area than the unheated portion 32. The cylindrical opening or passage 28 through the center of the ring 26 is sized to have a diameter which is only slightly greater than the diameter of the barstock 18 before it is heated. Therefore, as the ring 26 is telescopically moved along the barstock 18 from the cool end portion 32 toward the hot end portion 20 (see FIG. 4), the ring will move into interfering engagement with the relatively hot end portion at a point where thermal expansion has caused the transverse cross sectional area of the barstock to exceed the transverse cross sectional of the opening 28 through the ring 26. The interference between the ring 26 and heated end 20 of the barstock 18 interrupts axial movement of the ring toward the right (as viewed in FIG. 4).

The axial location along the barstock 18 where interferring engagement occurs between the ring 26 and the heated end portion 20 of the barstock is rather imprecise due to variations in the extent of expansion of the barstock. However, the ring 26 is precisely located by a gaging operation before the head end 12 of the fastener is formed. After the ring 26 has been telescopically moved into interferring engagement with the relatively hot end portion 20 of the barstock 18, the barstock is placed between a stationary die 40 (see FIG. 5) and a movable die 42. The die 42 has a semicircular cavity 44. The die 40 has a similar cavity 46 (FIG. 6). When the dies 40 and 42 are closed (FIG. 6), the ring 26 is disposed in the two cavities 44 and 46.

The cavity 44 is partially defined by a semicircular end surface 48 (FIG. 5) which extends perpendicular to a longitudinal central axis of the barstock 18. The end surface 48 is abuttingly engaged by an annular end surface 50 of the ring 26 when the dies 40 and 42 are closed. A semicircular outer side surface 52 of the cavity 44 (FIG. 5) engages an annular opposite end surface 54 of the ring 26 when the dies 40 and 42 are closed. The cylindrical outer side surface 56 of the ring 26 is abuttingly engaged by a corresponding semicircular side surface 58 of the cavity 44.

Figure 5:
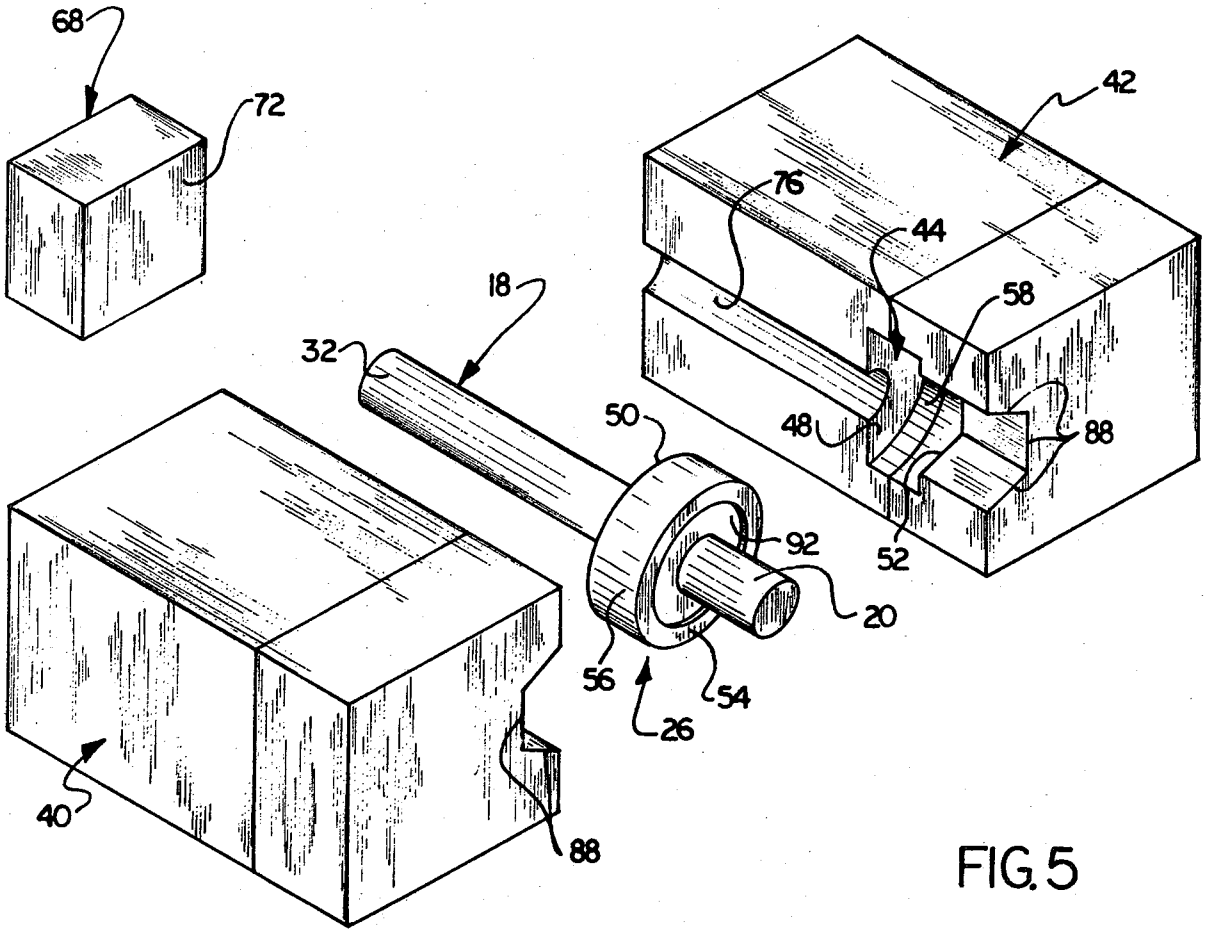
FIG. 5 is a schematic illustration depicting the relationship between a pair of dies, a gage block, the workpiece, and the ring, the dies being shown in an open condition.
Figure 6:
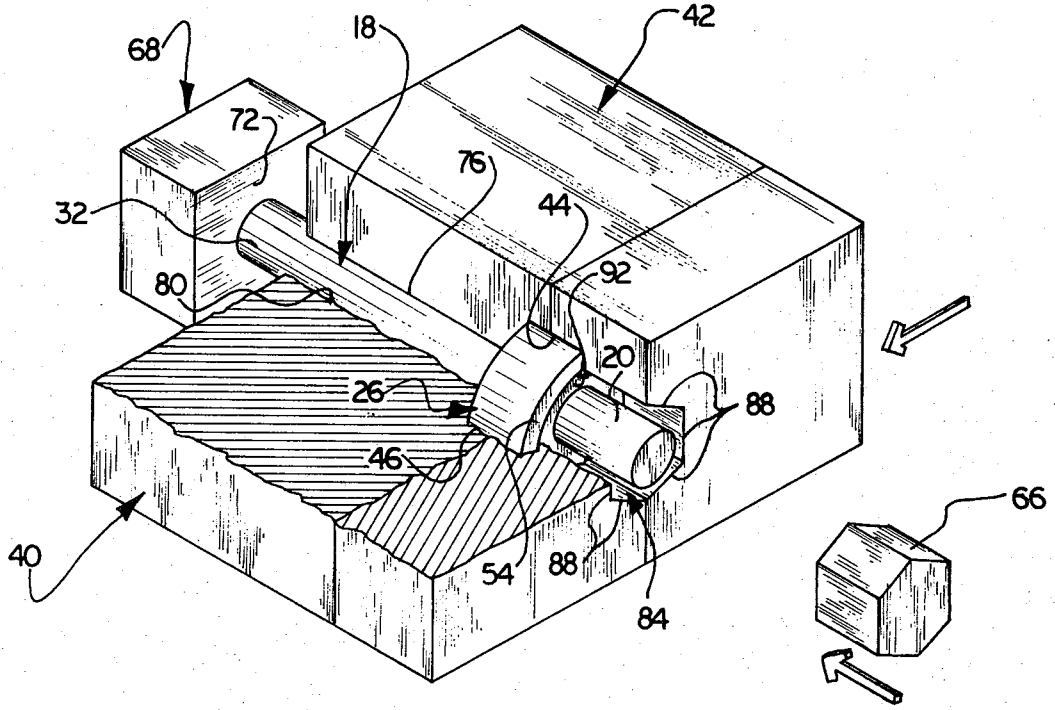
FIG. 6 is a schematic illustration depicting engagement of the dies with the ring and the workpiece to hold them against axial movement relative to each other and to define a die cavity around one end portion of the workpiece.

Although only the ring cavity 44 in the die 42 has been fully illustrated in FIG. 5 of the drawings, it should be understood that the ring cavity 46 (see FIG. 6) in the die 40 is the same size and shape as the ring cavity 44. The ring cavities 44 and 46 engage the opposite end surfaces 50 and 54 of the ring 26 to hold the ring against axial movement relative to the dies 40 and 42.

Before the dies 40 and 42 are fully or tightly closed, a ram or header 66 (FIG. 6) is moved into abutting engagement with the heated end 20 of the barstock 18. Continued movement of the header 66 presses the relatively cold end 32 of the barstock against a gage block 68. When the end surface 70 (see FIGS. 2 and 4) of the barstock 18 has been moved into abutting engagement with a gaging surface 72 (FIG. 6) on the block 68, the barstock 18 is accurately located relative to the dies 40 and 42. Since the ring 26 is accurately located in the cavities 44 and 46 in the dies 40 and 42, the ring 26 is accurately located relative to the barstock 18.

The dies 40 and 42 are then tightly closed by moving the die 42 toward the stationary die 40 in the manner indicated schematically in FIG. 6. When this happens, the longitudinally extending barstock is firmly gripped between the dies 40 and 42. Thus, the die 42 is provided with an axially extending gripping groove 76 (see FIG. 5) which has a longitudinally extending semicircular side surface which engages one side of the piece of barstock 18. The opposite side of the barstock 18 is firmly held in a corresponding groove 80 (FIG. 6) formed in the stationary die 40.

The gripping action of the side surfaces of the grooves 76 and 80 against opposite sides of the barstock 18 firmly hold the barstock against axial movement relative to the dies 40 and 42 and the ring 26. Of course, at this time the ring 26 is firmly held against axial movement relative to the dies 40 and 42 in the ring cavities 44 and 46.

Once the dies 40 and 42 have firmly closed in the manner illustrated in FIG. 6, the relatively hot end portion 20 of the barstock 18 is surrounded or circumscribed by a hexagonal die cavity 84. The die cavity 84 has a transverse cross sectional configuration which corresponds to the cross sectional configuration of the hexagonal head 12 of the fastener 10. Thus, the die cavity 84 is defined by a plurality of flat side surfaces 88 which are disposed in a hexagonal array about the longitudinal central axis of the barstock 18 in a coaxial relationship with the ring 26 and the barstock. It should be noted that the axially inner end of the die cavity 84 is defined by an annular end surface 92 on the ring 26.

The header or ram 66 is then moved into the die cavity 84 (see FIG. 6) to upset the hot end portion 20 of the barstock 18. As this occurs, an axial force is applied against the end surface of the barstock 18. However, the barstock is firmly held against axial movement relative to the ring 26 by the gripping action of the dies 40 and 42. Therefore, the application of an axial force against the hot end 20 of the barstock 18 by the header 66 is effective to upset or expand the hot metal of the barstock radially outwardly toward the side surfaces 88 of the die cavity 84 and to move the hot metal axially inwardly toward the end face 82 of the ring 26.

The continued application of force against the barstock 18 by the ram or header 66 is effective to shape the metal of the barstock against the surfaces 88 of the die sections 40 and 42 and against the ring surface 92. This hot working action results in arcuate formation of the head end portion 12 of the fastener. As the head end portion 12 of the fastener is being formed, the dies 40 and 42 firmly grip the shank 14 of the fastener to hold the fastener and ring 26 against axial movement relative to each other.

Since the hot metal of the end portion 20 of the barstock 18 is formed against the continuous annular end surface 92 of the ring 26, there is no flash formed at a joint between the dies under the head of the fastener. This results in the underside surface of the fastener head 14 being precisely formed to a desired configuration without a fin or flash. Of course, a slight fin or parting mark will be formed by flash along the sides of the head of the fastener where the dies 40 and 42 abut each other. However, the slight flash marks which occur at the corners of the hexagonal head of the fastener and are so slight as not to interfere with engagement of the head of the fastener by a wrench.

Figure 7:
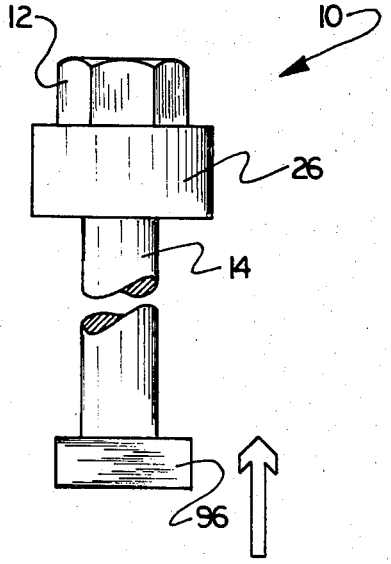
FIG. 7 is a schematic illustration depicting the manner in which a blow is applied to the shank of the fastener to remove the ring from the shank of the fastener.

Once the head end portion 12 of the fastener has been formed, the header 66 is withdrawn from the die cavity 84 and the dies 40 and 42 are opened. As the die 42 moves away from the stationary die 40, the fastener 14 can be withdrawn from the dies. At this time, the ring 26 is disposed on the shank 14 of the fastener directly under the head 12. In order to remove the ring 26 from the fastener 10, the fastener is held in a vertical position (see FIG. 7) and an end of the shank 14 of the fastener is tapped lightly with a tool 96. The tapping of the shank of the fastener with the tool 96 causes the ring to release and slide down the shank 14 of the fastener. The ring 26 can then be reused during the formation of a head end portion of another fastener.

In view of the foregoing it is apparent that the present invention provides a new and improved method of forming a fastener 10 having a head end 12 and a shank 14. When the fastener 10 is to be formed, one end portion 20 of a workpiece 18 is heated. A ring 26 is then moved telescopically along the workpiece 18 toward the hot end portion 20 of the workpiece. This axial movement of the ring 26 along the workpiece 18 is interrupted by interference between the ring and the hot end portion of the workpiece which expands as it is heated. It should be understood that although the ring 26 has been described herein as being moved axially relative to the workpiece, the workpiece could be moved axially relative to the ring if desired.

The ring 26 is then engaged by a pair of die blocks 40 and 42 and the workpiece 18 forced telescopically through the ring 26 into engagement with a gage block 68. This accurately locates the ring 26 in a desired position along the workpiece. The dies 40 and 42 then grip the relatively cold end portion 32 of the workpiece 18 and hold the ring 26 and workpiece against axial movement relative to each other. In addition to holding the ring 26 and workpiece 18 against movement relative to each other, the dies 40 and 42 cooperate with the ring 26 to form a die cavity 84 which surrounds the hot end portion 20 of the workpiece.

A header or ram 66 is then used to form the head end 12 of the fastener by hot working the workpiece 18 in the die cavity 84. As the material of workpiece 18 is hot worked, it is pressed against both an end surface 92 of the ring 26 and side surfaces 88 of the dies 40 and 42 to shape the head end 12 of the fastener 10. Once the head end 12 of the fastener has been formed by the hot working operation, the ring 26 is disengaged from the fastener and subsequently used in the formation of another fastener.

Having described one specific preferred embodiment of the invention, the following is claimed:

1. A method of forming a fastener having a head end portion and a shank portion, said method comprising the steps of providing a longitudinally extending workpiece having a uniform transverse cross sectional area throughout its length, heating an end portion of the workpiece so that the workpiece has a relatively hot end portion and a relatively cold end portion, said step of heating the workpiece including the step of increasing the transverse cross sectional area of the relatively hot end portion of the workpiece, providing a ring having a central opening with an area which is greater than the transverse cross sectional area of the cold end portion of the workpiece and less than the transverse cross sectional area of the hot end portion of the workpiece, effecting axial movement between the ring and workpiece with the ring circumscribing the relatively cold end portion of the workpiece, interrupting axial movement between the ring and workpiece by impacting engagement of the ring and the relatively hot end portion of the workpiece, applying force against the relatively hot end portion of the workpiece while holding the ring and workpiece against axial movement relative to each other to form the head end portion of the fastener, and thereafter effecting axial movement between the ring and the workpiece to disengage the ring from the shank portion of the fastener.

2. A method as set forth in claim 1 wherein the step of applying force against the hot end portion of the workpiece includes pressing the hot material of the workpiece against the ring.

3. A method as set forth in claim 1 wherein said step of holding the ring and workpiece against axial movement relative to each other includes the step of gripping the ring and workpiece with a plurality of dies, said step of applying force against the hot end portion of the workpiece includes pressing the hot material of the workpiece against surfaces of the dies.

4. A method of forming a fastener having a head end portion, said method comprising the steps of telescopically placing a ring on a longitudinally extending workpiece with a first end portion of the workpiece extending axially outwardly in a first direction from the ring and a second end portion of the workpiece extending axially outwardly in a second direction from the ring, gripping both the ring and the first end portion of the workpiece with a plurality of die sections to hold the ring against axial movement relative to the workpiece, said step of gripping both the ring and the first end portion of the workpiece with a plurality of die sections including effecting relative movement between the die sections to abuttingly engage a longitudinally extending side surface of the first end portion of the workpiece and a side surface area of the ring with the die sections, said step of effecting relative movement between the die sections including forming a die cavity which circumscribes the second end portion of the workpiece and which is at least partially defined by surfaces on the die sections and ring, applying force against the second end portion of the workpiece to shape the second end portion of the workpiece in the die cavity against surfaces on the die sections and ring to form the head end portion of the fastener while gripping both the ring and the first end portion of the workpiece with the die sections, thereafter, effecting relative movement between the die sections to separate them from both the ring and the workpiece, and removing the ring from the workpiece.

5. A method as set forth in claim 4 further including the steps of heating the second end portion of the workpiece prior to performing said step of placing the ring on the workpiece, said step of placing the ring on the workpiece including the steps of aligning the ring with the first end portion of the workpiece and effecting axial movement between the workpiece and ring to telescope the ring onto the workpiece from the first end portion of the workpiece after having performed said step of heating the second end portion of the workpiece.

6. A method of as set forth in claim 5 wherein said step of heating the second end portion of the workpiece includes the step of thermally expanding a portion of the workpiece, said step of placing the ring on the workpiece includes the step of engaging the portion of the workpiece expanded by the heating step with the ring.

7. A method as set forth in claim 6 further including the step of forcing the ring over at least part of the expanded portion of the workpiece to position the ring and workpiece axially relative to each other.

8. A method as set forth in claim 4 wherein said step of removing the ring from the workpiece includes the step of tapping the first end portion of the workpiece.

9. A method as set forth in claim 4 further including the step of heating the second end portion of the workpiece, said step of applying force against the second end portion of the workpiece including the step of hot working the workpiece in the die cavity while gripping both the ring and first end portion of the workpiece with the die sections.

10. A method as set forth in claim 4 further including the step of heating the second end portion of the workpiece so that the workpiece has a relatively hot end portion and a relatively cold end portion, said step of telescopically placing the ring on the workpiece including the step of telescoping the ring over the relatively cold end portion of the workpiece after having performed said step of heating the second end portion of the workpiece.

11. A method as set forth in claim 7 wherein the step of telescopically placing the ring on the workpiece includes the step of limiting the extent of telescopic relative movement between the ring and workpiece by abutting engagement between the relatively hot end portion of the workpiece and the ring.

12. A method of forming a fastener having a head end portion and a shank portion, said method comprising the steps of heating a first end portion of a longitudinally extending workpiece, a telescopically placing a ring on the workpiece after heating the first end portion of the workpiece, said step of telescopically placing a ring on the workpiece including the steps of axially aligning the ring with a second end portion of the workpiece and moving the ring axially along the workpiece from the second end portion of the workpiece toward the heated first end portion of the workpiece, gripping the ring and workpiece with a plurality of die sections to hold the ring and workpiece against axial movement relative to each other, said step of gripping the ring and workpiece being performed with the heated first end portion of the workpiece extending outwardly from the ring into a die cavity which is at least partially defined by the ring and the plurality of die sections and which has a configuration corresponding to the configuration of the head end portion of the fastener, applying force against the heated first end portion of the workpiece to shape the heated first end portion of the workpiece in the die cavity against the ring and die sections while holding the ring against axial movement relative to the workpiece with the die sections to form the head end portion of the fastener on one side of the ring with the shank portion of the fastener extending through the ring, disengaging the workpiece and ring from the die sections, and removing the ring from the shank portion of the fastener.

13. A method of as set forth in claim 12 wherein said step of heating the first end portion of the workpiece includes the step of thermally expanding a portion of the workpiece, said step of placing the ring on the workpiece includes the step of engaging the portion of the workpiece expanded by the heating step with the ring.

14. A method as set forth in claim 13 further including the step of forcing the ring over at least part of the expanded portion of the workpiece to position the ring and workpiece axially relative to each other.

15. A method as set forth in claim 12 wherein said step of gripping the workpiece includes the step of holding the workpiece against axial movement relative to the ring during said step of applying a force against the workpiece by gripping with the die sections a portion of the workpiece extending from the ring in a direction away from the die cavity.

16. A method as set forth in claim 12 wherein said step of removing the ring from the shank portion of the fastener includes the step of tapping the end of the shank portion of the fastener.

17. A method as set forth in claim 12 wherein the step of telescopically placing the ring on the workpiece includes the step of limiting the extent of telescopic relative movement between the ring and workpiece by abutting engagement between the relatively hot first end portion of the workpiece and the ring.

* * * * *